United States Patent [19]

Lee

[11] Patent Number: 4,870,762

[45] Date of Patent: Oct. 3, 1989

[54] SAFETY SHOE STRUCTURE

[76] Inventor: Martin Lee, Suite 704, President Building, 592, Lin-Shen North Road, Taipei, Taiwan

[21] Appl. No.: 250,163

[22] Filed: Sep. 28, 1988

[51] Int. Cl.[4] ..... A43C 13/14

[52] U.S. Cl. ..... 36/77 R

[58] Field of Search ..... 36/77 R, 77 M

[56] References Cited

U.S. PATENT DOCUMENTS

| | | | |
|---|---|---|---|
| 2,426,211 | 8/1947 | Heckman | 36/77 R |
| 2,795,868 | 6/1957 | Shultz | 36/77 R |
| 3,034,235 | 5/1962 | Hunting | 36/77 R |
| 3,165,841 | 1/1965 | Rollman | 36/77 R |
| 4,353,173 | 10/1982 | Paquet | 36/77 R |

FOREIGN PATENT DOCUMENTS

| | | | |
|---|---|---|---|
| 95061 | 11/1983 | European Pat. Off. | 36/77 R |
| 2822872 | 11/1979 | Fed. Rep. of Germany | 36/77 R |
| 1086135 | 2/1955 | France | 36/77 R |
| 1213077 | 3/1960 | France | 36/77 R |

*Primary Examiner*—Werner H. Schroeder
*Assistant Examiner*—Diana L. Biefeld
*Attorney, Agent, or Firm*—Sherman and Shalloway

[57] ABSTRACT

A safety shoe structure including a protective cap mounted above the toe receiving portion of the shoe and between the upper layer and the lining, in which the protective cap has a forward edge formed with a horizontal and inwardly extending lateral flange and a rear edge extended and engaged with a soft piece, while the sole is provided thereon with a generally U-shaped hard piece located at the forward end of the sole upon which the lateral flange rests and a sponge member covers the remaining portion of the sole, and an insole is provided onto the lateral flange and the sponge member.

8 Claims, 3 Drawing Sheets

SAFETY SHOE STRUCTURE

FIELD OF THE INVENTION

The present invention relates to a shoe structure, and more particularly to a safety shoe structure.

BACKGROUND OF THE INVENTION

In order to meet safety demands, the conventional safety shoe structure is normally relatively heavy and not much attention is given to whether its design complies with the foot's architecture or is comfortable to wear. Recently, a sports shoe-shaped safety shoe structure has become available on the market which is lighter than the conventional safety shoe and has an improved outer appearance: however, during assembly, rivets are riveted through the front wall of the sole, the protective cap, the lining and the vamp, so it still is not comfortable even after having been worn for a relatively long period of time.

It is therefore an object of the present invention to provide a safety shoe structure capable of being worn comfortably for a long period of time.

It is a further object of the present invention to provide a safety shoe structure using no rivets.

SUMMARY OF THE INVENTION

In the safety shoe structure according to the present invention, the protective cap has a forward edge formed with a horizontal and inwardly extending lateral flange and a rear edge extended with a soft piece; the forward end of the sole is provided with a generally U-shaped hard piece upon which the lateral flange of the protective cap rests and the remaining portion of the sole is further provided thereupon a sponge member having a forward edge complementary with the hard piece, and an insole is provided unto the lateral flange and the sponge member.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1:
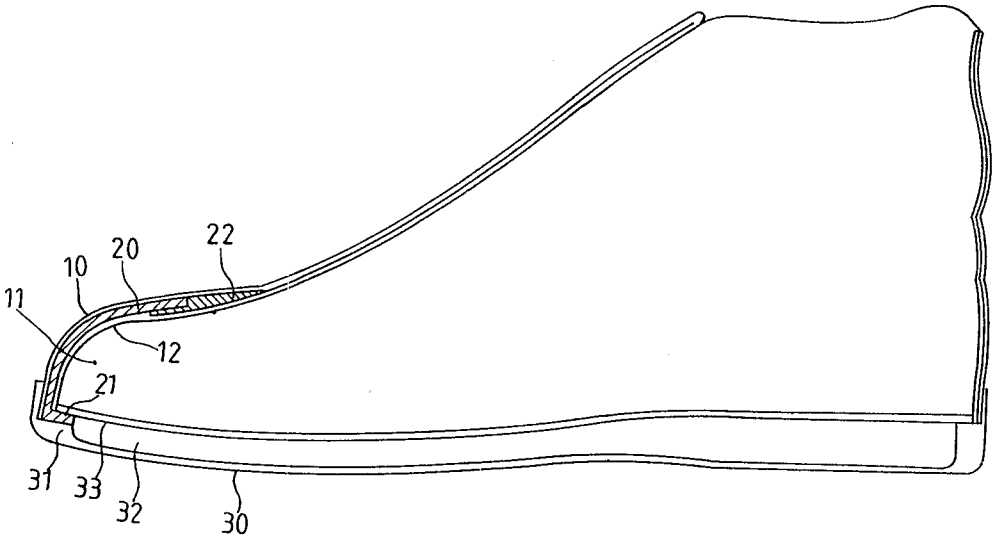
FIG. 1 is a schematically sectional view showing a safety shoe structure of the present invention.

Referring now to the drawings, especially FIG. 1, the safety shoe structure of the present invention includes an outer layer 10, a lining 12 matched under outer layer 10, a protective cap 20 mounted above toe portion 11 of the shoe and between outer layer 10 and lining 12, a sole 30, a sponge member 32 and an insole 33, and in which outer layer 10 and lining 12 preferably consist of three layers, namely a leather layer, an air-pervious woven fabric layer and an elastic layer made of polyurethane foam, which are substantially constructed in a manner similar to that of a known safety shoe, so their detailed description are thus omitted.

Figure 2:
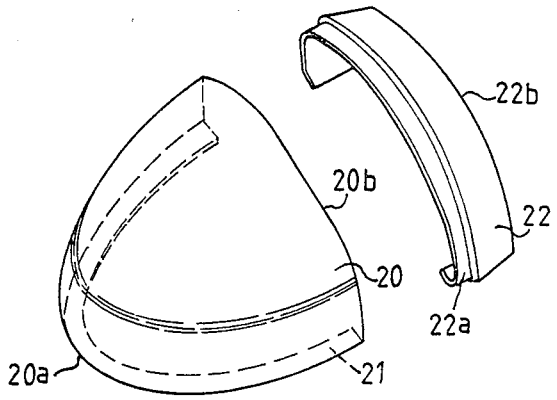
FIG. 2 is an enlarged perspective view showing a protective cap and an extended soft piece of the safety shoe structure of FIG. 1.
Figure 3:
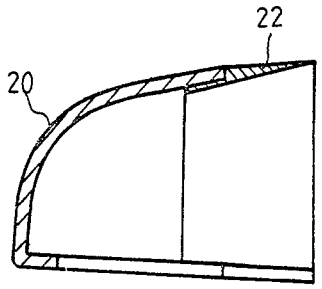
FIG. 3 is a diagramatic sectional view of the assembled protective cap and soft piece of FIG. 2

As shown in FIGS. 1 through 3, protective cap 20 is constructed in such a manner as to have a generally U-shaped forward edge **20*a* formed with a horizontally and inwardly extending lateral flange 21 of more than 4 mm width and an approximately arch-shaped rear edge 20*b* extended by a relatively soft piece 22. Soft piece 22 includes a forward stepped portion 22*a* adapted to be attached beneath the rear edge 20*b* of protective cap 20 and a rear body portion 22*b* extending flushly from the top side of rear edge 20*b* and tapered to an edge that allows outer layer 10 to meet lining 12. With the provision of soft piece 22 extending continuously with protective cap 20, it is not only possible to strengthen and enhance the flexibility of the portion of the outer layer 10 located parallel to and near rear edge 20*b* of protective cap 20, but also to prevent outer layer 10 from breakage along rear edge 20*b*, which tends to happen in conventional safety shoe structures as the stiff rear edge 20*b*** always rubs against and wears through that portion when the shoe is worn.

Figure 4:
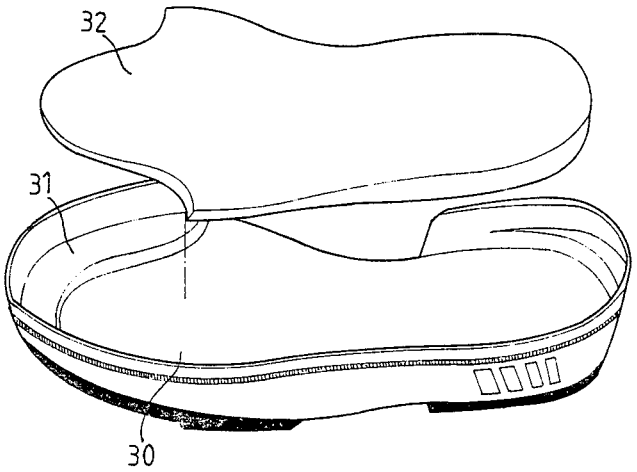
FIG. 4 is a perspective view showing the sole of the safety shoe structure of FIG. 1.

Referring to FIG. 4, sole 30 has an upper surface provided with a generally U-shaped relatively hard piece 31 integrally formed and located in the forward end of sole 30 using hard rubber or a steel sheet metal embedded in the sole upon which lateral flange 21 rests, and a sponge member 32 covers the remaining portion of sole 30 and has a shape cooperating with hard piece 31 to wholly cover the upper surface of sole 30 to promote the foot comfort of the wearer.

Figure 5:
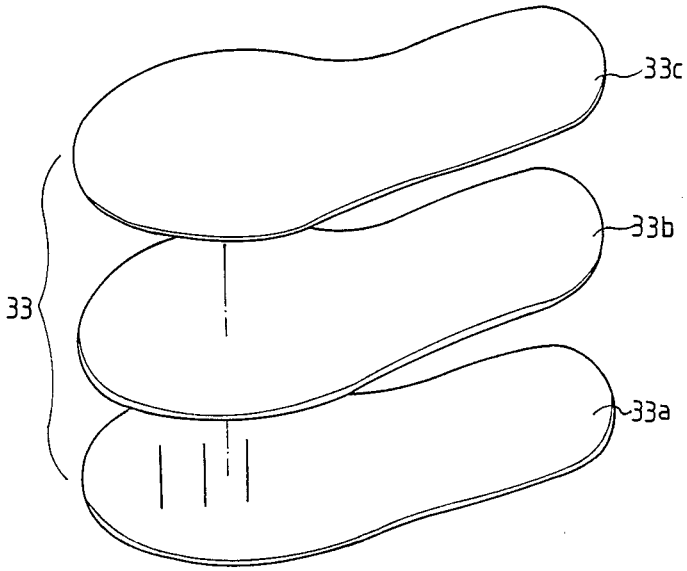
FIG. 5 is an exploded view f an insole of the safety shoe structure of FIG. 1.

As seen in FIGS. 1 and 5, onto lateral flange 21 and sponge member 32 a multilayer insole 33 is provided, which includes a hard bottom layer **33*a*, a middle sponge layer 33*b* and an upper woolen cloth layer 33*c* adhered together to cushion the foot when the safety shoe structure is worn. Hard bottom layer 33*a* is made of a suitable material such as so-called "hard board" in order to cooperate with protective piece 20 to resist spring back of sponge member 32 when the safety shoe suffers an external blow. Further, hard bottom layer 33*a* may be provided with transverse slits in the front portion thereof in order to improve curvability. 15**. Through the above description, it should now become readily apparent how and why the present invention can achieve the objectives it contemplates.

What is claim is:

1. A safety shoe structure comprising a sole, an upper having an outer layer and a lining and being provided over and around the front periphery of said sole to define a toe receiving portion at the front end portion of said shoe, and a protective cap provided above said toe receiving portion and between said outer layer and said lining, said protective cap being formed in a shape as to have a generally U-shaped forward edge and an approximately arch-shaped rear edge, said safety shoe further comprises:

a lateral flange extending horizontally and inwardly from said forward edge of said protective cap:

a soft piece connected at said rear edge of said protective cap having a forward stepped portion adapted to engage beneath the lower surface of said rear edge and a rear body portion flushly extending from said rear edge and tapered to an edge so as to be snugly interposed between said outer layer and said lining;

a hard raised portion formed at the front end of the upper surface of said sole and adapted to provide a base for resting said lateral flange:

a sponge member provided onto the remaining portion of said upper surface of said sole; and an insole provided on said lateral flange and said sponge member.

2. A safety shoe structure as recited in claim 1, wherein said insole includes a hard bottom layer to resist the spring back of said sponge member.

3. A safety shoe structure as recite in claim 1, wherein said lateral flange comprises an outer edge, which connects with said forward edge of said protective cap, and an inner edge which is disposed inwardly of said outer edge a first distance which is less than a second distance which said protective cap extends rearwardly, said outer edge and said inner edge being substantially parallel to one another.

4. A safety shoe structure as recited in claim 3, wherein said inner edge of said lateral flange is U-shaped.

5. A safety shoe is recited in claim 1, wherein said lateral flange extends rearwardly and inwardly from said forward edge of said protective cap a first distance which is equal to a third distance which said hard raised portion extends rearwardly and inwardly.

6. A safety shoe as recited in claim 1, wherein said hard raised portion includes an upper surface and wherein said lateral flange extends rearwardly and inwardly so as to cover substantially the entire upper surface of said hard raised portion.

7. A safety shoe structure as recited in claim 1, wherein said lateral flange is so dimensioned as to have a width of more than 4 mm.

8. In a safety shoe structure comprising a sole, an upper having an outer layer and a lining and being provided over and around a front periphery of said sole to define a toe receiving portion at a front end portion of said shoe, and a protective cap provided above said toe receiving portion and between said outer layer and said lining, said protective cap being formed in a shape so as to have a generally U-shaped forward edge and an approximately arch-shaped rear edge, the improvement comprises:

a lateral flange extending horizontally and inwardly from said forward edge of said protective cap; and a hard raised portion integrally formed at the front end of the upper surface of said hole and adapted to provide a base for supporting said lateral flange.

* * * * *

UNITED STATES PATENT AND TRADEMARK OFFICE

CERTIFICATE OF CORRECTION

PATENT NO. : 4,870,762
DATED : October 3, 1989
INVENTOR(S) : Martin Lee

It is certified that error appears in the above-indentified patent and that said Letters Patent is hereby corrected as shown below:

Col. 4, line 24, delete "hole" and substitute therefor --sole--.

Signed and Sealed this

Twenty-ninth Day of August, 1995

Bruce Lehman

*Attest:*

BRUCE LEHMAN

*Attesting Officer*

*Commissioner of Patents and Trademarks*

US004870762B1

(12) REEXAMINATION CERTIFICATE (4411th)

United States Patent

Lee

(10) Number: US 4,870,762 C1

(45) Certificate Issued: Aug. 14, 2001

(54) SAFETY SHOE STRUCTURE

(76) Inventor: Martin Lee, Suite 704, President Building, 592, Lin-Shen North Road, Taipei (TW)

Reexamination Request:
No. 90/003,884, Jun. 30, 1995

Reexamination Certificate for:

| | |
|---|---|
| Patent No.: | **4,870,762** |
| Issued: | **Oct. 3, 1989** |
| Appl. No.: | **07/250,163** |
| Filed: | **Sep. 28, 1988** |

Certificate of Correction issued Aug. 29, 1995.

(51) Int. Cl.[7] ..... A43C 13/14
(52) U.S. Cl. ..... 36/77 R
(58) Field of Search ..... 36/72 R, 77 R, 36/77 M

(56) References Cited

U.S. PATENT DOCUMENTS

| | | |
|---|---|---|
| 2,426,211 | 10/1947 | Heckman . |
| 2,795,868 | 6/1957 | Shultz . |
| 3,043,235 | 5/1962 | Hunting et al. . |
| 3,165,841 | 1/1965 | Rollman . |
| 3,950,865 | 4/1976 | Gray . |
| 4,011,667 | 3/1977 | Greenan . |
| 4,353,173 | 10/1982 | Paquet . |
| 4,574,497 | 3/1986 | Jindra . |

FOREIGN PATENT DOCUMENTS

| | | |
|---|---|---|
| 2822872 | 11/1979 | (DE) . |
| 0095061 | 11/1983 | (EP) . |
| 1086135 | 2/1955 | (FR) . |
| 1213077 | 3/1960 | (FR) . |
| 1098708 | 1/1986 | (GB) . |

OTHER PUBLICATIONS

T. Sisman Shoe Co. Brochure, May 1, 1971.

*Primary Examiner*—Marie Denise Patterson

(57) ABSTRACT

A safety shoe structure including a protective cap mounted above the toe receiving portion of the shoe and between the upper layer and the lining, in which the protective cap has a forward edge formed with a horizontal and inwardly extending lateral flange and a rear edge extended and engaged with a soft piece, while the sole is provided thereon with a generally U-shaped hard piece located at the forward end of the sole upon which the lateral flange rests and a sponge member covers the remaining portion of the sole, and an insole is provided onto the lateral flange and the sponge member.

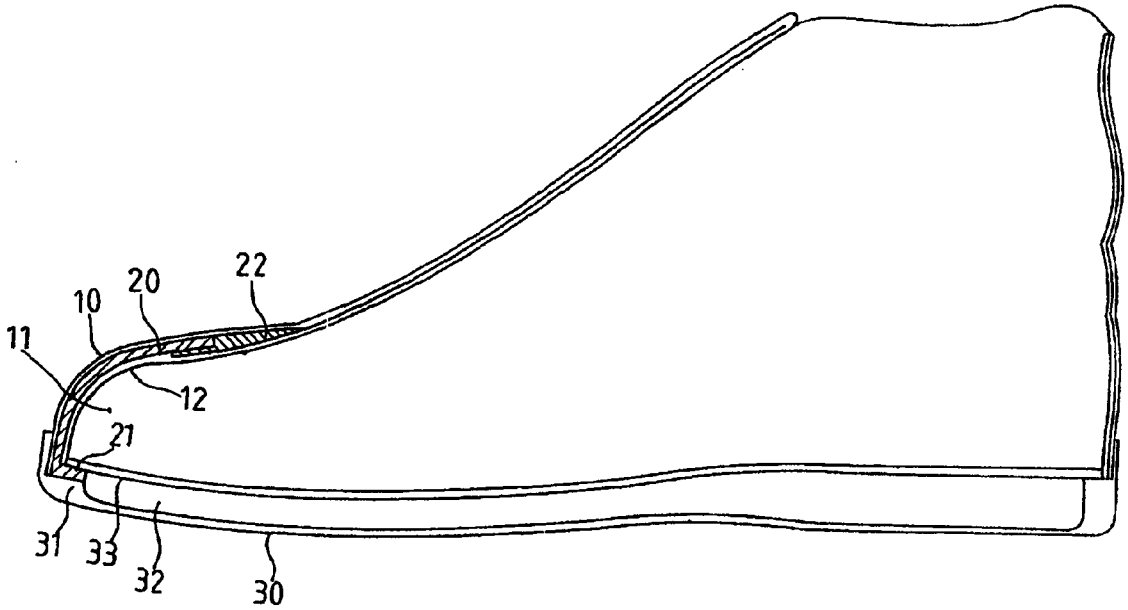

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *